United States Patent [19]

Meng

[11] Patent Number: 4,962,779

[45] Date of Patent: Oct. 16, 1990

[54] MULTI-FUNCTION UMBRELLA

[76] Inventor: Yeong-Ming Meng, 4-1 Fl., No. 171, Loh Yeh St., Taipei, Taiwan

[21] Appl. No.: 447,013

[22] Filed: Dec. 6, 1989

[51] Int. Cl.[5] ..... A45B 3/00

[52] U.S. Cl. ..... 135/16; 135/19.5; 135/DIG. 10

[58] Field of Search ..... 135/20 TH, DIG. 10, 135/16, 19.5, 66

[56] References Cited

U.S. PATENT DOCUMENTS

| | | | |
|---|---|---|---|
| 1,642,336 | 9/1927 | Friedrichs | 135/22 |
| 2,201,602 | 5/1940 | Wiles | 135/DIG. 10 X |
| 2,507,919 | 5/1950 | Mazzeo | 135/DIG. 10 X |
| 2,597,172 | 5/1952 | Parker | 135/66 X |
| 3,658,076 | 4/1972 | Yasuda | 135/22 |
| 4,093,969 | 6/1978 | Maynor, Jr. | 135/DIG. 10 X |
| 4,583,080 | 4/1986 | DeVito et al. | 135/DIG. 10 X |
| 4,848,385 | 7/1989 | Pennella | 135/DIG. 10 X |
| 4,872,468 | 10/1989 | Cole | 135/16 |

FOREIGN PATENT DOCUMENTS

| | | | |
|---|---|---|---|
| 0114929 | 8/1984 | European Pat. Off. | 135/DIG. 10 |
| 216281 | 8/1941 | Switzerland | 135/DIG. 10 |
| 232005 | 4/1944 | Switzerland | 135/DIG. 10 |
| 479271 | 11/1969 | Switzerland | 135/20 TH |

*Primary Examiner*—David A. Scherbel
*Assistant Examiner*—Lan Mai
*Attorney, Agent, or Firm*—Steinberg & Raskin

[57] ABSTRACT

A multi-function umbrella includes a multi-section rod, a handle portion provided on a lower end of the rod and a canopy body provided on an upper end of the rod. A flashlight is provided on top of the rod. A buzzer, a gas container and a battery are provided in the handle portion. A switch is provided on the handle portion in order to control the buzzer and the discharge of the gas. Another flashlight is pivotally provided on the handle portion. A flexible sleeve is provided on top of the handle portion for receiving the canopy body when the canopy body is folded.

2 Claims, 4 Drawing Sheets

MULTI-FUNCTION UMBRELLA

BACKGROUND OF THE INVENTION

The present invention relates to an umbrella, and more particularly to a multi-function umbrella.

Protective means for women, such as a buzzer, a gas sprayer etc., are generally carried in a bag or the like. It takes time to open the bag to get the protective means out and to make the protective means ready for use. It is impossible for users to hold the protective means in their hand all the time. The conventional protective means therefore has a low practicability.

Umbrellas, which are often black in color are used on rainy days when visibility is very poor. Walking on rainy nights is especially hazardous and the conventional umrella does not help the visibility of the user.

The present invention has arisen to mitigate and/or obviate the afore-described disadvantages of the conventional umbrella and protective means.

SUMMARY OF THE INVENTION

The primary objective of the present invention is to provide a multi-function umbrella which has a flashlight provided on top of the umbrella in order to provide a warning signal to indicate a pedestrian.

Another objective of the present invention is to provide a multi-function umbrella which provides a gas sprayer, a buzzer, a flashlight and a compass in a handle portion of the umbrella which can be carried in the users' hands so that the sprayer and the buzzer are ready for use at all times.

Still another objective of the present invention is to provide a multi-function umbrella which provides a sleeve in which to pack the umbrella when the umbrella is folded so that the umbrella can be used as a baton or the like for protective purposes.

In accordance with one aspect of the invention, there is provided a multi-function umbrella including a multi-section rod, a handle portion provided on a lower end of the rod and a canopy body provided on an upper end of the rod. A flashlight is provided on top of the rod. A buzzer, a gas container and a battery are provided in the handle portion. A switch is provided on the handle portion in order to control the buzzer and the discharge of the gas. A second flashlight is pivotally provided on the handle portion. A flexible sleeve is provided on top of the handle portion for receiving the canopy body when the canopy body is folded.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
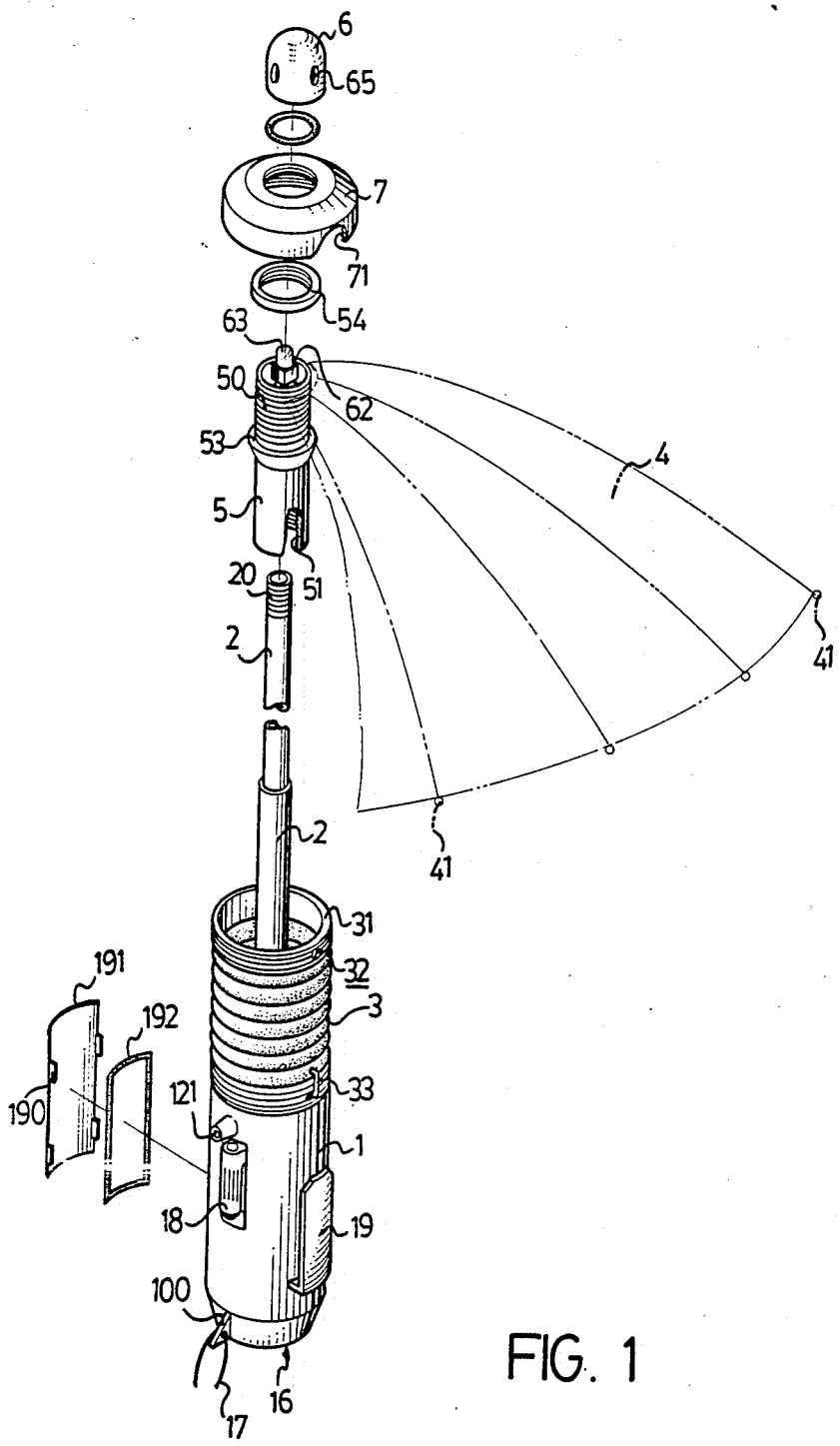
FIG. 1 is an exploded view of a multi-function umbrella in accordance with the present invention.
Figure 2:
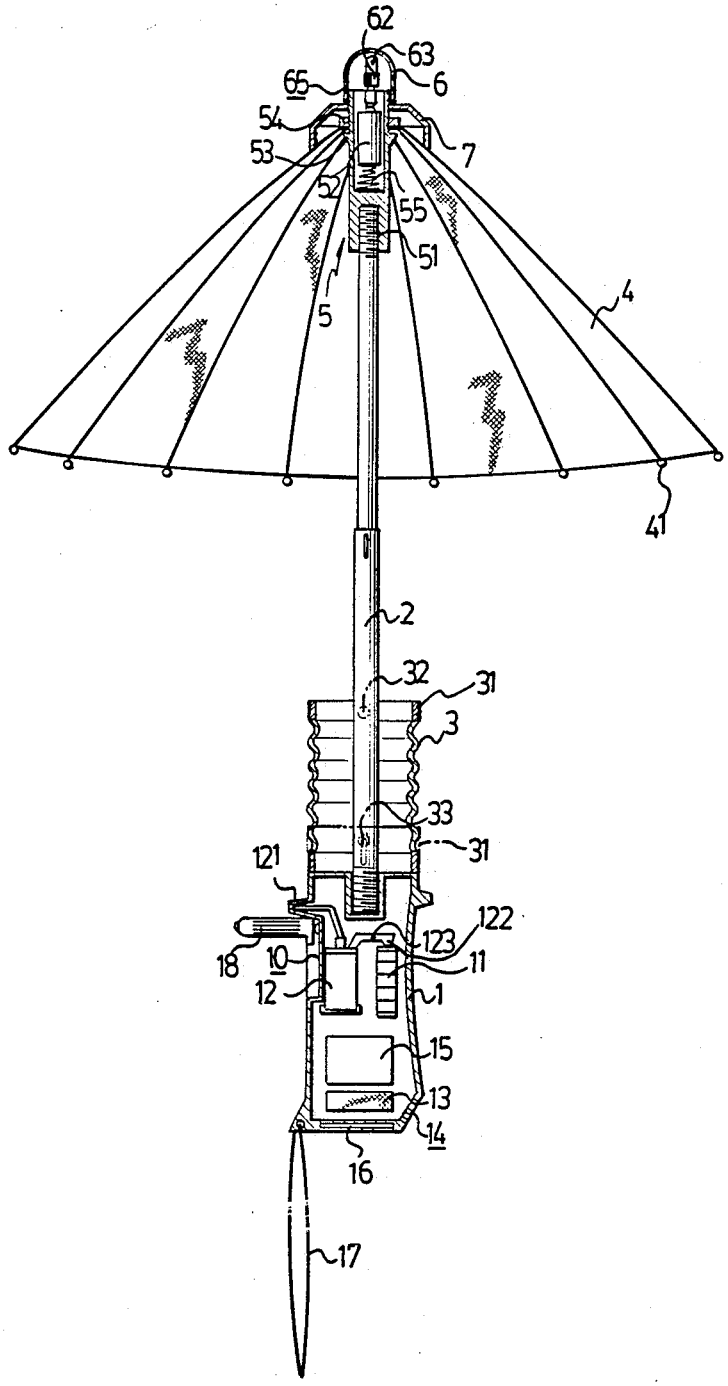
FIG. 2 is a partial cross-sectional view of the umbrella.

Referring to the drawings and initially to FIGS. 1 and 2, the multi-function umbrella in accordance with the present invention comprises generally a canopy body 4 provided on an upper end of an extendible multi-section rod 2 and a handle portion 1.

The canopy body 4 is foldably pivoted on an upper end of the multi-section rod 2 which are both of conventional configurations and will not be described in detail. An outer thread 20 is formed on an upper portion of the rod 2. A head 5 has an inner thread 51 formed in a lower portion thereof for threadedly engaging with the outer thread 20 of the rod 2. The head 5 is substantially a cylindrical tube with an outer thread 50 formed on an upper portion thereof and an annular flange 53 formed on a middle portion thereof. A retaining ring 54, a cap 7 and a lid 6 are threadedly engaged onto the upper portion of the head 5 in series. A center portion of the cloth part of the canopy body 4 is clamped between the retaining ring 54 and the annular flange 53. The cap 7 has an annular flange extending axially downward with an inner thread 71 formed therein. A plurality of openings 65 are formed in the lid 6.

As shown in FIG. 2, a first battery 52 and a spring 55 are provided in the upper portion of the head 5. A lower end of a lamp bulb 63 is electrically connected to a center electrode of the battery 52. A first switch 62 is provided on the lid 6 and controls an electrical connection between the lamp bulb 63 and the case electrode of the battery 52 so as to turn on and turn off the lamp bulb 63. The light emitted from the lamp bulbs 63 is visible through the openings 65 so as to provide a warning signal. It is preferable that a reflective sheeting is provided on top of the canopy body 4 and a reflective material is applied on the beads 41 of the bones of the canopy body 4. The light emitted from the lamp bulb 63 further makes the reflective sheeting and the reflective material "shine" so that the multi-function umbrella in accordance with the present invention is suitable for use as a temporary reflective road sign.

A second battery 15 and a buzzer 13 are provided in a lower portion of the handle portion 1. A second switch 11, which is a multi-selection switch and will be described in detail hereinafter, is provided on the handle portion 1. A compass 16 is provided on a lower end of the handle portion 1 so as to provide another safety function. A gas container 12 with a discharge pipe is further provided in the handle portion 1, the discharge pipe is connected to a nozzle 121. A lever 122 which has substantially an inverted U-shape is pivotally supported in the handle portion 1 about a pivot axle 123. One end of the lever 122 contacts an upper end of the gas container 12 and the other end of the lever 122 is located on an upper end of the second switch 11 so that the upper end of the gas container 12 is depressed down when the switch 11 is pushed to an uppermost position and so that the gas is discharged through the nozzle 121. An opening (not shown) is formed in the handle portion 1 for providing an access to the battery 15, the buzzer 13 and the gas container 12. The opening is closable by a retaining plate 191 which has four resilient flanges 190 formed on both ends. A sealing elemet 192 is provided for making a water tight for the opening.

A flashlight 18 which is substantially a lamp holder with a bulb is pivotally disposed on the handle portion 1. A recess 10 is formed in the handle portion 1 for receiving the flashlight 18. The flashlight 18 is generally received within the recess 10 as shown in FIG. 1. The flashlight 18 is rotatable for 90 degrees as shown in FIG. 2. The flashlight 18 is retained at this position by a hand which is holding the handle portion 1. A plurality of holes 14 are formed in the lower end of the handle portion 1 to disperse the sound emitted by the buzzer 13. A wrist strap 17 passes through a hole in a tab 100 provided on the lower end of the handle portion 1.

Figure 4:
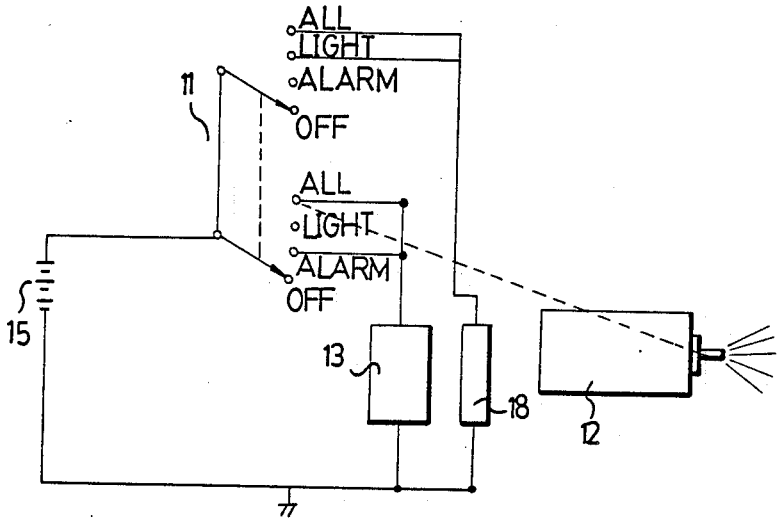
FIG. 4 is a schematic view illustrating the multi-selection switch.

Referring next to FIG. 4, illustrated is a schematic view of the multi-selection switch 11. The battery 15, the buzzer 13 and the second flashlight 18 are electrically connected to the switch 11 in parallel. As shown in FIG. 4, the buzzer 13 is energized when the switch 11 is pushed upward for one step and the second flashlight 18 is energized when the switch 11 is pushed upward for another step. When the switch is pushed to an uppermost position, both the buzzer 13 and the second flashlight 18 are energized. In addition, as described above, when the switch 11 is pushed to an uppermost position, the upper end of the gas container 12 is depressed downward by the lever 122 so that the gas is discharged from the nozzle 121.

Figure 3:
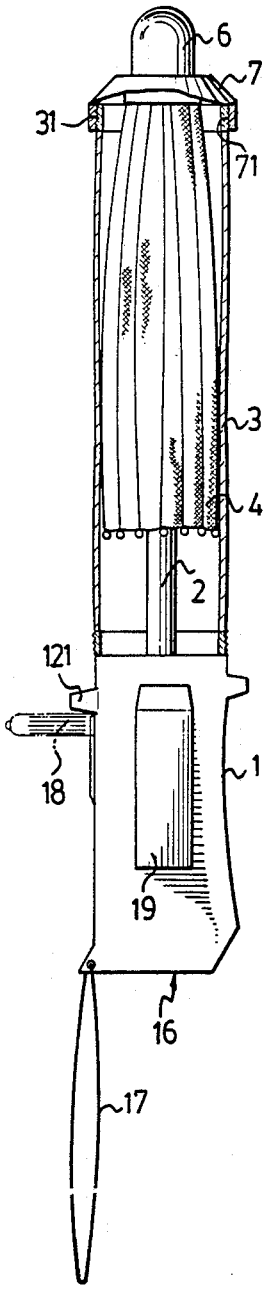
FIG. 3 is a plan view of the umbrella when in a folded state.

A flexible sleeve 3, which is substantially made of cloth, is provided around the rod 2 above the handle portion 1. A mounting ring 31 with an outer thread and a hole 32 is provided on top of the sleeve 3. A substantially U-shaped retaining pin 33 is provided on a lower portion of the sleeve 3 which is integrally connected to an upper portion of the handle portion 1. A lower leg of the retaining pin 33 is fixed on the handle portion 1. When the multi-function umbrella in accordance with the present invention is in a folded state, the sleeve 3 is extended and the mounting ring 31 is threadedly engaged with the cap 7 so that the canopy body 4 is rigidly retained within the sleeve 3 and so that the umbrella can be used as a protective baton as shown in FIG. 3. When the sleeve 3 is retracted, an upper leg of the retaining pin 33 is engaged into the hole 32 of the mounting ring 31 so as to firmly retain the sleeve 3 as shown in dotted lines in FIG. 2. A retaining clasp 19 is provided on the handle portion 1 so that the multi-function umbrella in accordance with the present invention can be hung on a waist of a user.

Accordingly, the multi-function umbrella in accordance with the present invention can be carried by hand, and the protective apparatus is ready for use at any time.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A multi-function umbrella comprising generally a multi-section rod, a handle portion provided on a lower end of said rod and a canopy body provided on a top end of said rod; a head which is generally a cylindrical tube being threadedly engaged on said top end of said rod; a spring; a first battery and a first bulb being provided in said head; and a lid with a first switch being threadedly engaged on a top end of said head, said first switch controlling an electrical circuit of said first bulb, at least on opening being formed in said lid so that light emitted from said first bulb is visible through said opening; a cap with an inner thread being threadedly engaged on said top end of said head; a lower end of a flexible sleeve being fixed on a top portion of said handle portion, a mounting ring with an outer thread being provided on top of said sleeve; and said mounting ring of said sleeve being threadedly engageable with said cap when said canopy body is folded.

2. A multi-function umbrella according to claim 1, wherein a lower leg of a retaining pin which is substantially U-shaped is fixed on said top portion of said handle portion; and a hole is formed in said mounting ring so that an upper leg of said retaining pin is engageable with said hole when said sleeve is retracted.

* * * * *